364-422
10/29/85 XR 4,549,431 SR

United States Patent [19]
Soeiinah

[11] Patent Number: 4,549,431
[45] Date of Patent: Oct. 29, 1985

[54] MEASURING TORQUE AND HOOK LOAD DURING DRILLING

[75] Inventor: Edy Soeiinah, Carrollton, Tex.

[73] Assignee: Mobil Oil Corporation, New York, N.Y.

[21] Appl. No.: 568,303

[22] Filed: Jan. 4, 1984

[51] Int. Cl.[4] ..... E21B 45/00; E21B 49/00
[52] U.S. Cl. ..... 73/151; 175/45; 364/422
[58] Field of Search ..... 73/151; 364/422; 175/40, 45

[56] References Cited

U.S. PATENT DOCUMENTS

| | | | |
|---|---|---|---|
| 3,324,717 | 6/1967 | Brooks et al. . | |
| 3,740,739 | 6/1973 | Griffin, III et al. . | |
| 3,800,277 | 3/1974 | Patton et al. . | |
| 3,866,468 | 2/1975 | Smith et al. . | |
| 4,250,758 | 2/1981 | Pitts, Jr. et al. | 73/151 |
| 4,285,236 | 8/1981 | Chien | 73/151 |
| 4,382,381 | 5/1983 | Soeiinah | 73/151 |
| 4,384,483 | 5/1983 | Dellinger et al. | 73/151 |

FOREIGN PATENT DOCUMENTS 1320999 9/1971 United Kingdom .

*Primary Examiner*—Howard A. Birmiel
*Attorney, Agent, or Firm*—Alexander J. McKillop; Michael G. Gilman; Charles J. Speciale

[57] ABSTRACT

In a computer aided method of detecting problems in the drilling of a well, the hook load is measured while free rotating, while moving the string out of the well for an incremental distance, and while moving the drill string into the hole the same incremental distance. These hook loads are used in determining the effective friction factor of the drill string as a function of depth. The hook loads and free rotating torque are plotted as a function of time in order to produce an indication of hole problems.

15 Claims, 12 Drawing Figures

FRICTION FACTOR PLOT OF WELL NO. 1

$12\frac{1}{4}$ INCH HOLE

MEASURING TORQUE AND HOOK LOAD DURING DRILLING

BACKGROUND OF THE INVENTION

This invention relates to the drilling of a well in the earth, and more particularly to measuring torque and hook load in a process for detecting problems in the drilling operation.

The problems encountered in drilling through the earth to very deep depths have been well documented and successfully solved. These problems are exacerbated in directional drilling where the path of the drill bit deliberately deviates substantially from the vertical direction. The insertion of tubulars, drill strings, casings, and tubing into very high angle boreholes is particularly difficult.

More specifically, the drilling problems which occur in directional drilling include keyseating which occurs in severely deviated wells when the diameter of the hole at the point of curvature is not sufficient to allow free movement of the drill string. If the situation is not corrected by boring out the well at the critical point, the drill string will become stuck. Differential pressure sticking is a problem caused by the pressure of the drilling mud pushing the drill string against one wall of the well so as to block off drilling mud from an area of the drill string at which a low pressure is developed. This problem, if not identified and corrected promptly, will cause sticking. Ploughing is a borehole problem resulting from the tool joints and/or stabilizers cutting into soft formations or settled cuttings as the drill string moves axially. The accumulation of cuttings at one location in the well will eventually disrupt the drilling operation. Drilling muds with low lubricity will increase the drag and torque during the drilling operation, and in some cases make the drilling operation impossible.

It is an object of the present invention to provide an improved method of measuring the pick up, running in, and free rotating loads on the drill string for use in a computer aided method of determining drilling problems such as that described above.

It is another object of the present invention to plot hook loads as a function of time as a way of identifying drilling problems.

SUMMARY OF THE INVENTION

In practicing the present invention, a rotating drill bit is positioned at a particular depth in the well, and the steady state hook load is measured. Then, the drill string is moved out of the well with no rotation for a distance equal to the length of the longest joint of drill pipe in the string. While moving the string out of the hole, the first and overall maximum hook loads and steady state hook load are measured. Then the drill string is moved into the well for the same distance with no rotation. While moving the drill string into the hole, the first and overall minimum hook loads and steady state hook load are measured and recorded. These recorded hook loads are digitized and used to determine the effective friction factor of the drill during pick up and running in. By comparing the effective friction factor determined from first and overall maximum pick up hook load, steady state pick up hook load, first and overall minimum run in hook load, and steady state run in hook load, drilling problems are identified.

It has been found that the hook load fluctuates significantly so that there are many possible measurements of hook load during picking up and running in. By using the aforementioned measured measured hook loads I have found that better determinations of pick up and run in friction factors can be obtained for the purpose of identifying problems in the well.

Further in accordance with the present invention, other measurements of torque and hook load are made and recorded. These measurements are plotted as a function of time to provide a valuable aid in analyzing the nature of drilling problems. I have found that these measurements are useful in ascertaining the exact nature of the problem in the well. More specifically, the steady state torque on the drill string i.e., the average between the steady state maximum and minimum torque, is measured during free rotation of the drill string, The steady state hook loads are measured while moving the drill string out of the well and while moving the drill string into the well. These are plotted as a function of time with a resolution of at least one torque or hook load sample per second. The resulting plots are an important aid in identifying hole problems.

In accordance with another important aspect of the present invention, the rotation of the drill string is stopped for a period of time before the drill string is moved out of the hole and the rotation is stopped for a period of time before the drill string is moved into the hole. By stopping the rotation for this period of time, differential pressure sticking is more easily identified.

The foregoing and other objects, features and advantages of the invention will be better understood from the following more detailed description and appended claims.

SHORT DESCRIPTION OF THE DRAWINGS

FIG. 1 shows a well drilling operation in which the present invention is used to detect problems;

FIGS. 2A, 2B, and 2C respectively show the drill string during free rotation, the drill string moving out of the hole and the drill string moving into the hole;

DESCRIPTION OF THE PREFERRED EMBODIMENT

Figure 1:
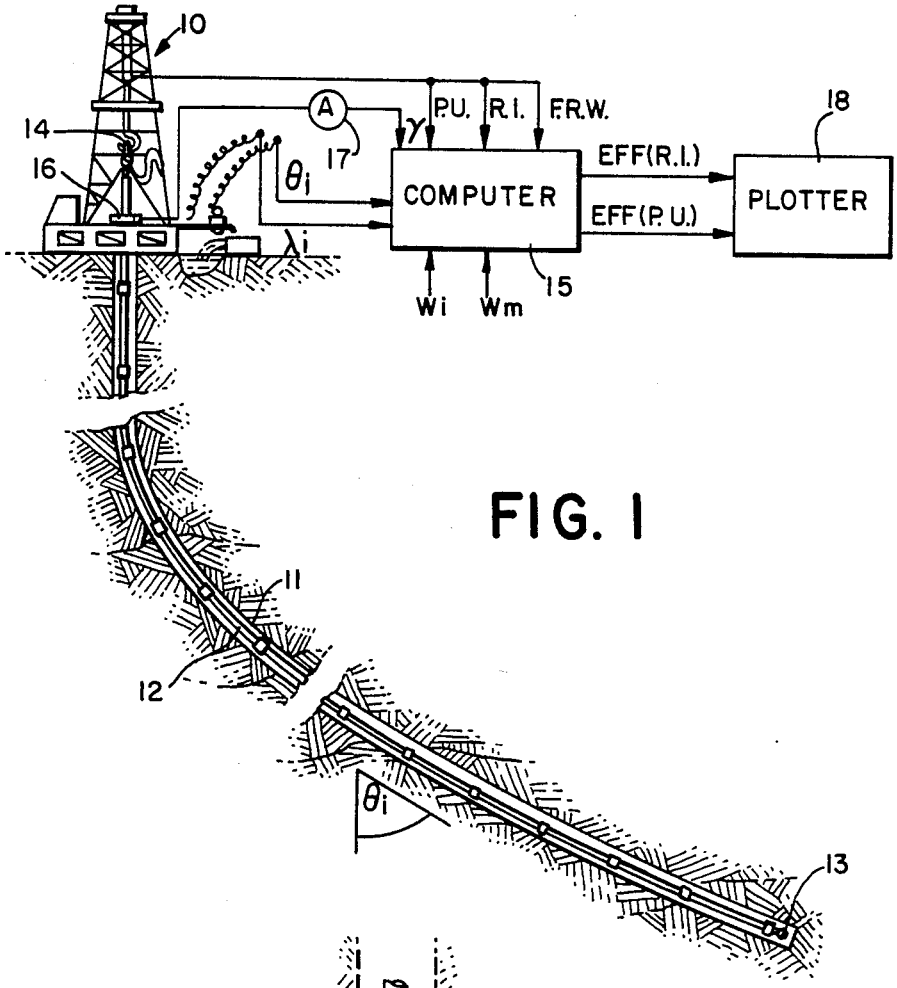

In FIG. 1, a conventional drilling rig 10 is disposed over a borehole 11. A drill string 12 includes the usual drill pipe, stabilizers, collars, and bit 13. Drilling mud is pumped from a supply sump into the drill string and is returned in a conventional manner. Changes in the drill mud pressure may be used to convey downhole parameters to the surface by using logging while drilling apparatus. For example, the trajectory of the drill string, including inclination and azimuth may be transmitted uphole.

The drilling rig 10 successively picks up the drill string 12 and runs it into the hole through drilling mud to the bottom of the well. In accordance with the present invention, at a plurality of successive depths of the drill string in the well, the load on the hook 14 is measured during free rotating, during pick up, and during running in. At each of these depths the free rotating torque is measured. This is the torque required to rotate the drilling string freely in the hole when it is not being moved up or down. These measurements are digitized and applied as inputs to the digital computer 15.

The torque on the drill string is determined by measuring the amperage to the motor 16 by use of ammeter 17. The amperage may be converted to foot pounds by an appropriate conversion factor.

Figure 6:
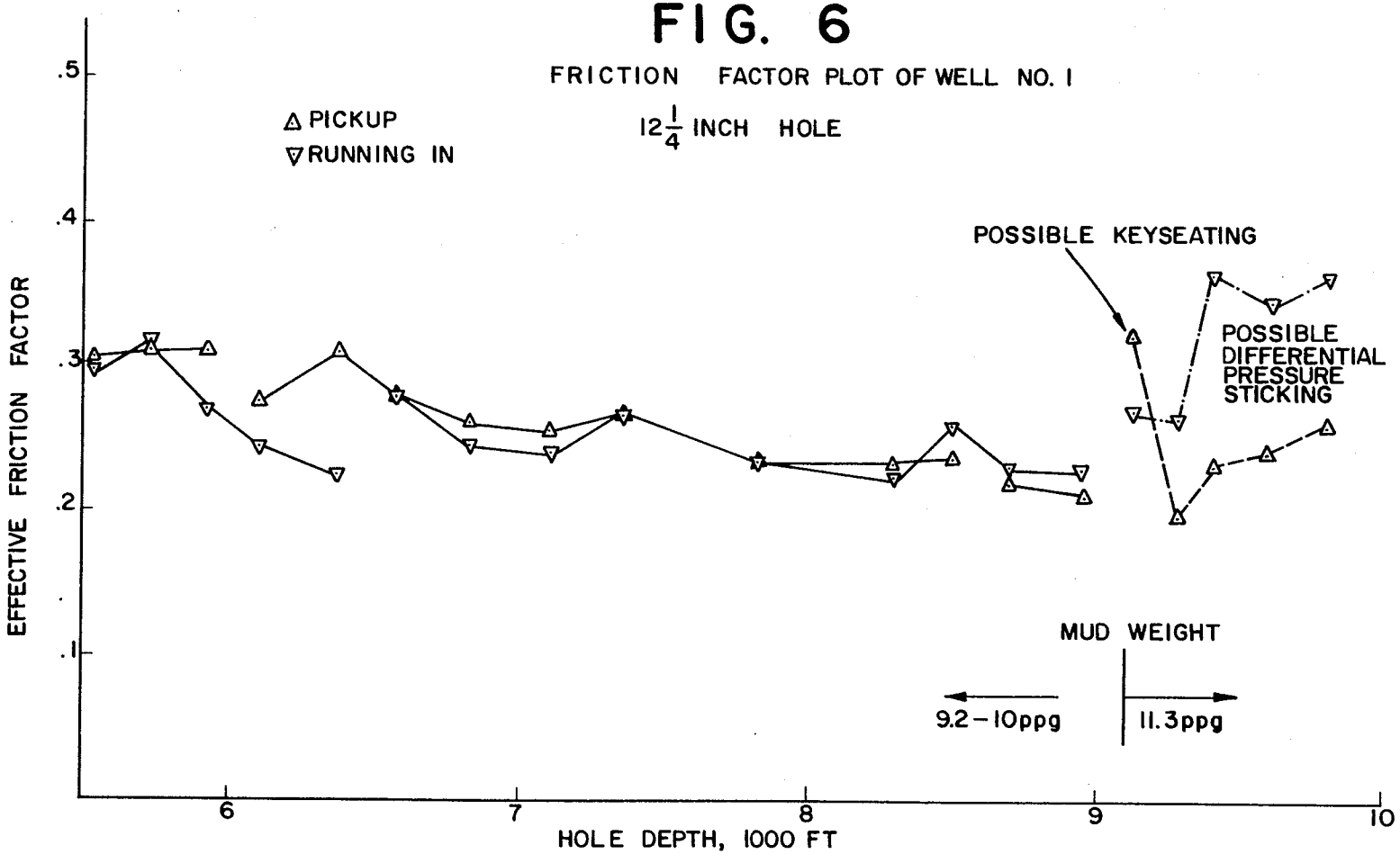
FIG. 6 is an output plot showing effective friction factor as a function of depth during pick up and running in for one exemplary well.

Other digitized inputs to the computer include the hole survey data including azimuth and inclination, the properties of the drill string including drill string dimensions and weights of drill pipe, drill collars and stabilizers; and the properties of the drilling mud including its weight. From these digitized parameters, digital computer 15 determines the effective friction factor (effective coefficient of friction) during run in, EFF (RI) and the effective friction factor during pick up, EFF (PU). This is repeated for successively deeper depths of the bit in the well. The plotter 18 plots the effective friction factor during pick up and the effective friction factor during running in as a function of depth. From these plots, an example of which is shown in FIG. 6, any problems in the drilling can be discerned from a deviation in the two plots or an abnormal deviation of the effective friction factor from the normal.

Figure 2A:
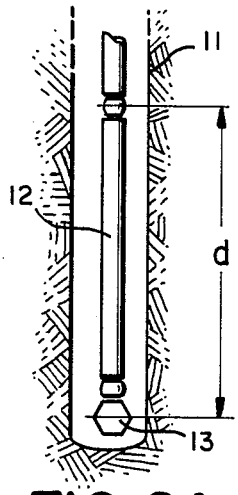
Figure 2B:
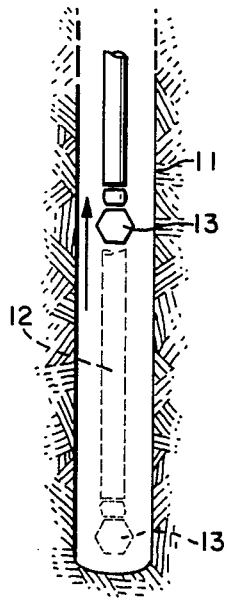
Figure 2C:
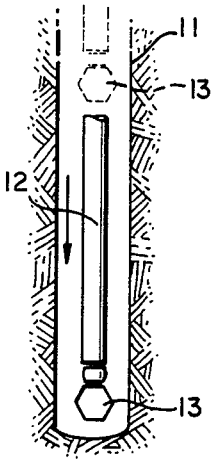

In accordance with the present invention, the measurements of free rotating, pick up and run in hook load and of free rotating torque are made in an advantageous manner depicted in FIGS. 2A–2C.

Figure 3A:
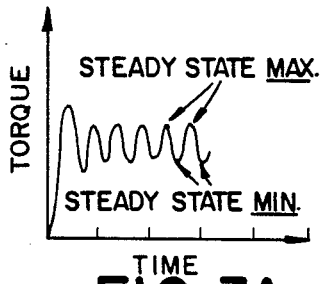
FIG. 3A shows the torque as a function of time during free rotation of the drill string.
Figure 3B:
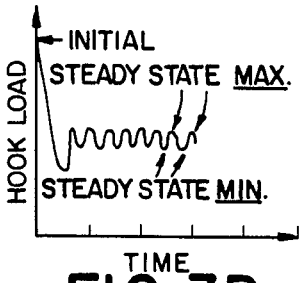
FIGS. 3B and 3C show the hook load during free rotation for two different situations.
Figure 3C:
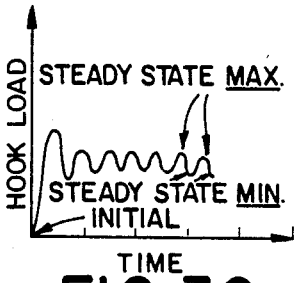

FIG. 2A depicts the positioning of the bit 13 at a particular depth in the well. At this depth, the drill string is free rotated. The bit 13 is off the bottom, with the drill string picked up by at least 30 feet. When the drill string is free rotated, the initial hook load is measured and recorded. The drill string is rotated slowly, approximately 40 rpm, for 30 seconds. While the drill string is being free rotated, the steady state maximum and steady state minimum torque are measured. FIG. 3A depicts the torque as a function of time. As previously mentioned, the torque can be measured by recording the rotating motor amperage or by converting amperage to foot pounds by a conversion factor. The steady state maximum hook load and steady state minimum hook loads are measured and recorded. The steady state hook load is the average of these two measurements. FIG. 3B shows the hook load as a function of time in this free rotating condition. The hook load decreases from an initially high value to a lower steady state value which fluctuates between a steady state maximum and a steady state minimum value. The fluctuations of the hook load are caused by the rotation of the bit and drill string which encounter differing forces as they are rotated. The fluctuations are also caused by the flexibility of the pipe which twists as it rotates. FIG. 3C shows another situation wherein hook load was measured during free rotation of the drill string. In this case, the drill string was lowered to the depth at which the vertical movement of the drill string was stopped and the string and bit were free rotated. In this case, the hook load increases from a lower initial value and then approaches the steady state value which fluctuates between a steady state maximum and steady state minimum. The average of the steady state maximum and minimum hook loads is the "free rotating load" used in the determinations of effective friction factor.

After the free rotation depicted in FIG. 2A the rotation is stopped for a period of time. The drill string is kept stationary for thirty seconds before it is moved upward or downward to ensure the detection of hole problems such as differential pressure sticking and cuttings settling. These hole problems are more pronounced after the drill string has been left stationary for some time. The thirty seconds duration is selected because it appears to be the minimum time needed to detect the hole problems. However, it can be increased up to the actual time the drill string is left stationary while adding a joint of drili pipe without causing any problem. The closer the stationary period represents the actual stationary time in normal drilling operation, the more accurate the calculations of the effects of hole problems will be.

After the stationary period, the drill string is then moved slowly out of the hole, without rotation, at about thirty feet per minute for a distance equal to the length of the longest joint of drill pipe inside the hole. It is very important to move the drill string slowly to negate the effects of inertia, swab and surge. The distance of movement of the drill string is selected to be equal to the length of the longest joint of drill pipe inside the hole in order to have at least one tool joint passing through all wellbore locations, one joint above the drill collars. This is to ensure the detection of all localized hole problems associated with tool joint, such as key seating and formation sloughing.

Figure 4A:
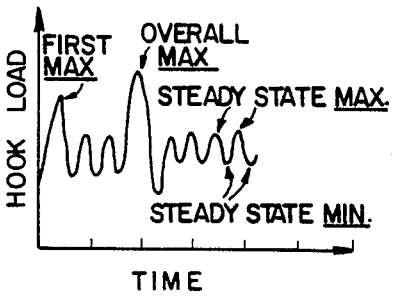
FIGS. 4A and 4B show the hook load while the drill string is being moved out of the hole for two different situations.

FIG. 2B depicts the movement of the drill string from its dotted line position to the full line position over a distance d. While moving the drill string the first and overall maximum hook loads are measured and recorded. FIG. 4A shows the hook load as a function of time during pick up of the drill string. In this case, the hook load increases from a low initial value to a first maximum value. This is a normal increase in hook load as the upward movement of the drill is started. After several fluctuations, the hook load increases to an overall maximum value before decreasing to its steady state fluctuations. This overall maximum excursion in FIG. 4A is indicative of a possible drill string problem. The values of the first and overall maximum hook loads and the steady state hook load are digitized and each is used as the "pick up load" to determine effective friction factors during pickup.

Figure 4B:
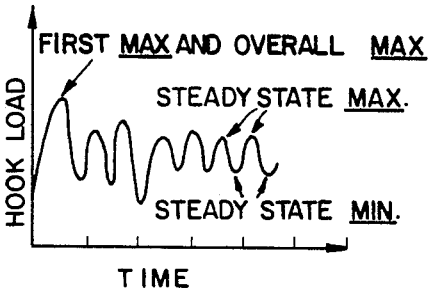

FIG. 4B shows another situation in which hook load was measured during pick up. In this case, the hook load increased from its initial value to the first maximum which is also the overall maximum value.

During pick up the steady state maximum and steady state minimum hook loads are measured and recorded along with the first maximum and overall maximum hook loads. Again, the initial hook load, steady state maximum, steady state minimum hook load, steady state maximum torque, steady state minimum torque, are measured and recorded.

Then, the drill string is moved into the well over the same distance that it was moved out of the well. This is depicted in FIG. 2C wherein the bit moves from its dotted line position to the full line position over the length d. In this case, the first minimum, overall minimum, steady state maximum, and steady state hook loads are measured and recorded. These are shown for two different situations in FIGS. 5A and 5B. The first and overall minimum hook loads and the steady state hook loads are each used as the "running in load" in determining effective friction factor.

The overall maximum/minimum hook loads are particularly important as they reflect the drags due to friction and hole problems. The first maximum/minimum hook load is also important in this respect.

Figure 5A:
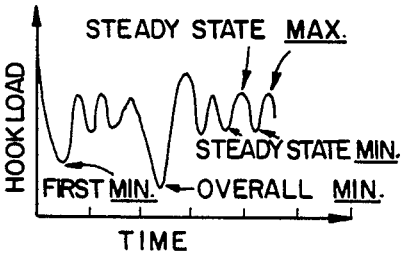
FIGS. 5A and 5B show the hook load while moving the drill string into the well for two different situations.
Figure 5B:
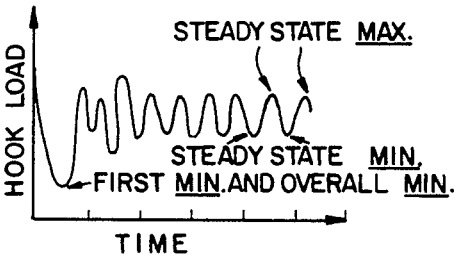

The overall maximum hook and steady state hook load during pick up and the overall minimum steady state hook load measured during run in are digitized and each is used in the computer-aided method of detecting problems in the drilling of the well. From these parameters and from the digitized hole survey, the effective friction factor of the drill string during pick up and running in are determined. The process is repeated at successively deeper depths of the bit in the well and the effective friction factor is plotted to produce a plurality of plots, one of which is shown in FIG. 6. Plots of the type shown in FIG. 6 have been successfully used to identify particular drilling problems. The measurement method of the present invention provides another marked improvement in further identifying drilling problems. Plots of the type shown in FIGS. 3, 4 and 5 are very useful in detecting drilling problems because they have sufficient reolution to identify these problems. Prior art measurements of hook load have not been made with sufficient resolution to be useful in accordance with the present invention. I have found that a resolution of at least one hook load measurement per second is sufficient for the practice of the invention. The resulting plots of hook load versus time are significant tools in the identification of drilling problems. For example, if the first measured minimum hook load is very high, such as is depicted in FIG. 5B, there is an indication of differential pressure sticking. If the maximum or minimum occurs at a later time, such as in FIG. 4A, or FIG. 5A, this is an indication of a hole problem such as key seating, formation sloughing, or hole cleaning. Ideally, and where there are no hole problems, if the drill string is moved slowly up or down, the hook load immediately approaches its steady state value in which it fluctuates between a steady state maximum and a steady state minimum. By recording the hook load as a function of time, valuable information as to the nature of the hole problem is obtained.

In key seating the tool joint may not initially engage the well casing. However, as the drill string is moved upwardly, or downwardly, this joint may come in contact with the casing and cause key seating. Therefore, FIGS. 4A and 5A are indicative of a situation where key seating is occurring after the drill string starts to move.

The present invention requires that load and torque measurements be taken frequently at strategic locations in order to monitor the hole condition. What, where, when, and how these measurements should be taken will now be discussed. Rig time of about 4 to 5 minutes is required to take a set of load and torque measurements.

The load and torque measurements should be taken frequently to detect changes in the hole condition. Measurements taken at the following depth and time intervals are exemplary.

1. While Drilling a. No measurement is needed if the hole depth is less than 1,000 feet past the kick-off-point.

b. Measurements should be taken with the bit near bottom after a new bit is run into the hole, but before drilling is started.

c. Measurements should be taken with the bit near bottom every 150 feet or 24 hours, whichever comes first, as drilling progresses.

d. Right after drilling is stopped, measurements should be taken with the bit near bottom before tripping out.

e. Measurements should be taken with the bit near bottom right before and right after changing the mud properties such as mud weight, viscosity and yield point.

f. Measurements should be taken with bit near bottom whenever there is a sudden change in load or torque.

g. Measurements should be taken while tripping at about an 200–300 feet interval.

While a particular embodiment of the invention has been shown and described, various modifications are within the true spirit and scope of the invention. The appended claims are, therefore intended to cover all such modifications.

What is claimed is:

1. In the computer-aided method of detecting problems in the drilling of a well in the earth, the method of measuring the pick up, running in and free rotating loads on the drill string at a particular depth of the bit in said well comprising:

positioning said bit at said particular depth;

free rotating said drill string;

while free rotating, measuring the steady state hook load on said drill string;

moving said drill string out of said well for an incremental distance;

while moving said drill string, measuring and recording the initial and overall maximum hook loads and the steady state hook load;

moving said drill string into said well over said distance;

while moving, measuring and recording the initial and overall minimum hook loads and the steady state hook load.

2. The method recited in claim 1 wherein the rotation of said drill string is stopped for a period of time before the step of moving said drill string out of said hole or moving said drill string into said hole.

3. The method recited in claim 1 wherein said drill string is rotated slowly and constantly.

4. The method recited in claim 1 wherein said drill string is moved over the same distance out of said well and into said well.

5. The method recited in claim 4 wherein said drill string is moved out of said well and into said well for a distance equal to the length of the longest joint of drill pipe in said string.

6. The method recited in claim 1 further comprising:

measuring and recording as a function of time the first and overall maximum hook loads and hook loads and steady state hook load while moving said drill string out of said well.

7. The method recited in claim 1 further comprising:

measuring and recording as a function of time the first and overall minimum hook loads and steady state hook loads while moving said drill string into said well.

8. The method recited in claim 1 further comprising:

measuring and recording the steady state maximum and minimum torque on said drill string while free-rotating it.

9. The method recited in claim 6, 7, or 8 wherein at least one measurement per second is recorded.

10. The method recited in claim 8 wherein the step of measuring the torque is carried out by measuring the amperage of the motor used to rotate said drill string.

11. The method recited in claim 1 further comprising:

plotting the measured hook loads as a function of time while moving said drill string out of said well.

12. The method recited in claim 1 further comprising:

plotting the measured hook loads as a function of time while moving said drill string into said well.

13. The method recited in claim 1 wherein the step of measuring the steady state hook load while free rotating said drill string comprises:

measuring the maximum steady state hook load;

measuring the minimum steady state hook load; and averaging said maximum and minimum steady state hook loads.

14. The method of detecting problems in the drilling of a well in the earth comprising:

successively picking and running in a drill string to engage a bit at the end thereof with the bottom of said well;

measuring and recording the free rotating loads as a function of time on said drill string at a particular depth of said bit in said well;

measuring and recording hook load as a function of time while moving said drill string out of said well to indicate the first and overall maximum hook loads and steady state hook load; and measuring and recording hook load as a function of time while moving said drill string into said well to indicate the first and overall minimum hook loads and steady state hook load whereby drilling problems are indicated by the recorded function of time measurements.

15. The method recited in claim 14 wherein at least one measurement per second is recorded.

* * * * *